United States Patent [19]

Heft et al.

[11] Patent Number: 4,481,491

[45] Date of Patent: Nov. 6, 1984

[54] INSULATED LATCH-CRADLE MECHANISM

[75] Inventors: Eldon B. Heft, West Hartford; Keith W. Klein, Simsbury, both of Conn.

[73] Assignee: General Electric Company, New York, N.Y.

[21] Appl. No.: 456,136

[22] Filed: Jan. 6, 1983

[51] Int. Cl.[3] ..... H01H 73/02

[52] U.S. Cl. ..... 335/21; 335/35

[58] Field of Search ..... 335/21, 35, 23, 37; 337/70

[56] References Cited

U.S. PATENT DOCUMENTS

| | | | |
|---|---|---|---|
| 2,797,278 | 6/1957 | Gelheiser et al. | 335/174 |
| 2,844,689 | 7/1958 | Middendorf | 335/35 |
| 2,897,314 | 7/1959 | Cole | 335/36 |
| 2,908,782 | 10/1959 | Kiesel et al. | 335/21 |
| 3,040,144 | 6/1962 | Norden | 335/37 |
| 3,246,098 | 4/1966 | Hall | 335/35 |
| 4,156,219 | 5/1979 | Coleman | 335/23 |

FOREIGN PATENT DOCUMENTS

| | | | |
|---|---|---|---|
| 456879 | 5/1979 | Canada | 335/35 |

*Primary Examiner*—E. A. Goldberg
*Assistant Examiner*—George Andrews
*Attorney, Agent, or Firm*—R. A. Menelly; W. C. Bernkopf; Fred Jacob

[57] ABSTRACT

An electric circuit breaker includes an insulated latch and cradle mechanism to prevent deleterious arc formation between their points of separation when the circuit breaker contacts are opened under short circuit conditions. One embodiment employs an insulated latch mounted on the breaker armature.

1 Claim, 8 Drawing Figures

INSULATED LATCH-CRADLE MECHANISM

BACKGROUND OF THE INVENTION

A plurality of circuit breaker assemblies are often mounted together such that the tripping mechanism of each individual breaker can commonly trip the remaining breakers. U.S. Pat. No. 3,288,965 to Klein and assigned to the common assignee of the instant invention describes such a common tripping breaker assembly and is incorporated herein for purposes of reference. Each individual breaker contains a movable contact assembly, an operating spring, a releasable member called a cradle and a latch member. The cradle tip is held by the latch member until the latch is moved from under the cradle by conventional thermal or magnetic means to release the cradle and trip the breaker. The operating spring directly connects the movable contact assembly to the metallic cradle and its tip rests directly upon the metallic latch. There is no intentional connection of the latch to the load terminal, therefore there is no intentional current flow through the cradle to the latch engaging surface.

When the breaker is subjected to short circuit currents much greater than the original design requirements, the contacts are separated by thermal and magnetic forces between them before the latch can be disengaged from the cradle by the conventional thermal or magnetic tripping means. The entire breaker housing is almost immediately filled with a conductive gaseous atmosphere which creates an unintentional circuit from the latch to the load terminal. When the latching surface of the cradle and the latch are separated by the conventional magnetic means, this unintentional circuit is interrupted and accompanied by arcing between the cradle and the latch which roughens the engaging surfaces and greatly increases the force required to trip the breaker during subsequent operations. One possible explanation for a part of this problem is that the cradle is connected to the movable contact arm by the operating spring. An insulator such as that described within U.S. Pat. No. 2,844,689 to Middendorf, was investigated but did not solve the problem. A proven explanation is the direct conduction path from the movable contact arm directly to the latching tip of the cradle, directly to the engaging surface of the latch, directly to the load terminal and all through the conductive atmosphere in parallel with the main inductive current path. The result of the roughened latching surfaces and accompanying increased force to trip is such that when a single breaker is called upon to trip several breakers within the common tripping assembly, its single operating spring cannot perform the required latching action.

The purpose of this invention is to provide means to prevent the occurrence of arcing between the cradle and the latch upon separation, and thereby preserve the required smoothness of their mating surfaces to retain the required common tripping action.

The aforementioned U.S. Pat. No. 2,844,689 to Middendorf describes a circuit breaker design wherein a substantial current flows through the mcvable contact arm and cradle to the latch before the breaker is tripped on overload. When the breaker is tripped, arcing occurs between the cradle and the latch as they become separated, causing their adjacent surfaces to become pitted. Middendorf found that the interposition of an insulating bearing between the movable contact arm and the cradle prevents the formation of an arc between the cradle and the latch at the instant of their separation upon tripping. The Klein breaker, which is fully described in the aforementioned patent, and to which reference can be made for a more detailed description of the cradle and latch assembly relative to the contact arm and operating spring, does not have a direct electrical path through the cradle and latch.

SUMMARY OF THE INVENTION

The invention comprises an insulated latch and cradle assembly for electric circuit breakers to prevent the occurrence of an electric arc between the cradle and the latch upon short circuit trip conditions. One embodiment comprises an insulated latch plate having an opening for receiving an end of the cradle and is attached to the bottom portion of the circuit breaker armature. A further embodiment comprises an insulated cradle which includes an insulated plate joining the cradle end to the body of the cradle.

Figure 3:
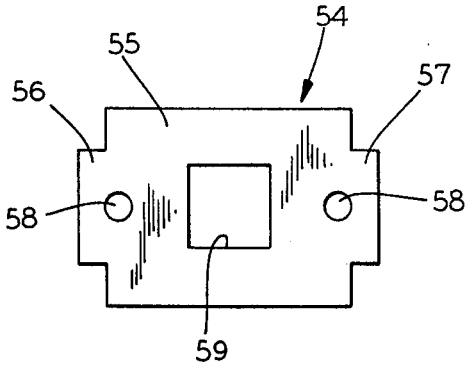
Figure 4:
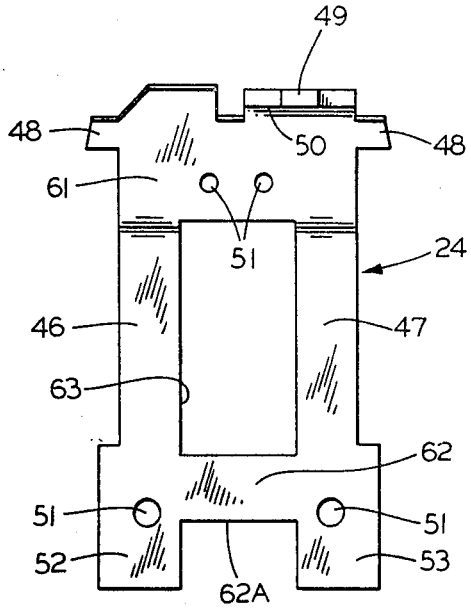
Figure 5:
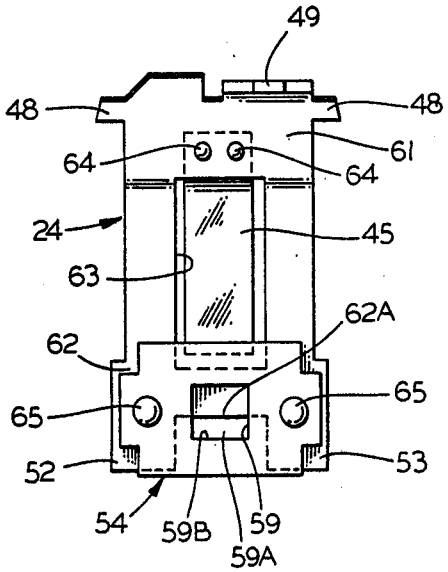
Figure 6:
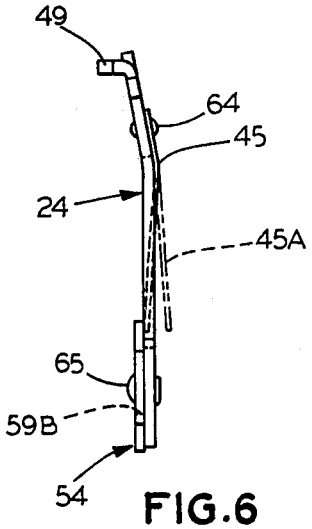
Figure 7:
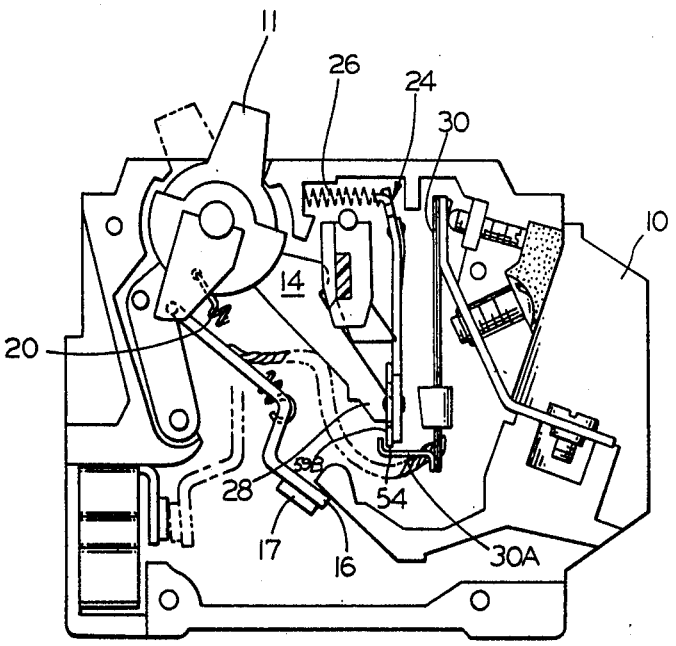
Figure 8:
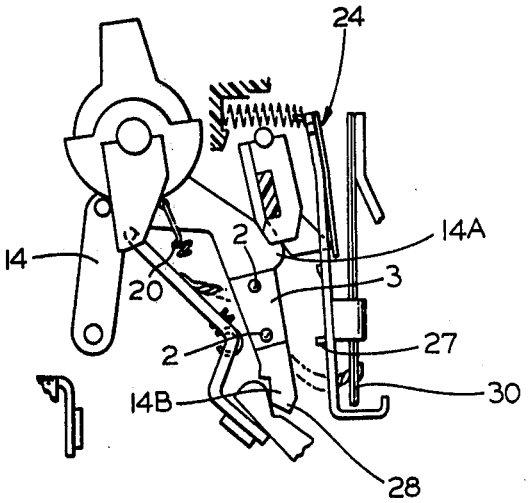

FIG. is a front view of a latch plate according to the invention;

FIG. 4 is a front view of a circuit breaker armature used with the latch plate depicted in FIG. 3;

FIG. 5 is a front view of an armature assembly containing the latch plate depicted in FIG. 3 attached to the armature depicted in FIG. 4;

FIG. 6 is a side view of the armature assembly depicted in FIG. 5;

FIG. 7 is a side view of a circuit breaker assembly with the cover removed and containing the armature assembly depicted in FIGS. 5 and 6; and FIG. 8 is a side view of a portion of a circuit breaker assembly containing an insulated cradle according to the invention.

DESCRIPTION OF THE PREFERRED EMBODIMENT

Figure 1:
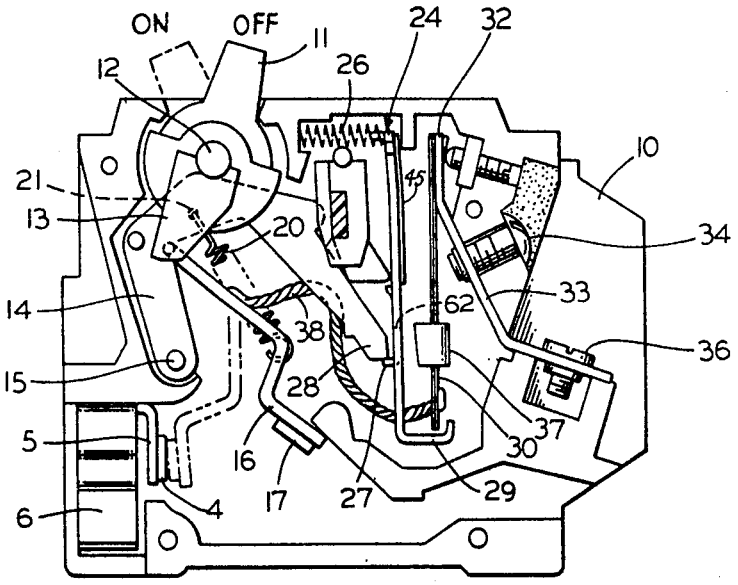
FIG. 1 (PRIOR ART)
FIG. 1 is a side view of a circuit breaker assembly according to the prior art with the cover removed.

FIG. 1 contains an electric circuit breaker similar to the type described in the aforementioned patent to Klein, which patent contains a complete description of the operation of a circuit breaker adaptable for common tripping assembly. The breaker consists of a plastic molded body 10 which supports an on-off handle 11 pivotably mounted to the body by means of a hub 12. A pair of spaced depending extensions on handle 11 straddle a releasable member, or cradle, 14 which is pivotally supported in the body by means of pivot 15. A stationary contact 4 is attached to a tang 5 which is supported by means of socket 6. A movable contact arm 16 contains a movable contact 17 for moving in and out of contact relation with the fixed contact by means of an over-center operating spring 20, which is attached to the movable contact arm at one end and is inserted within a hole 21 within cradle 14 at an opposite end. An armature 24 is supported at one end by means of an armature spring 26 and contains an extension 29 at its opposite end for mating with the botton end of a bi-metallic strip 30. When the breaker is in the un-tripped position shown in FIG. 1, end 28 of cradle 14 rests against latch 27 which comprises a projection extending from the bottom of opening 62 through armature 24. A resilient strip 45 is provided at the uppermost half of the armature for returning the armature and the latch to the un-tripped position after the breaker is tripped. Electrical connection is made with bi-metallic strip 30 by means of one end 32 of a terminal strap 33, which strap is mounted to the breaker by means of a mounting screw 34, and which receives terminal screw 36 at the opposite end. A magnetic field piece 37 consisting of a generally U-shaped metallic member at least partially encompassing the bi-metallic strip assists in tripping the breaker under short circuit conditions. Electrical connection between the bimetallic strip and the movable contact arm 16 is made by means of a flexible conductor 38. With the handle in the "on" condition, indicated in dashed lines in FIG. 1, electrical connection is made between stationary contact 4 and terminal screw 36 by means of the path provided through movable contact 17, contact arm 16, flexible conductor 38, bi-metallic strip 30 and terminal strap 33. It is to be noted that cradle 14 is supported within body 10 by the extensions 13, of handle 11. Both the handle and the extensions are made of an electrically insulating material so that the cradle only contacts an electrically conducting member at two points. One point of contact is at the junction of spring 20 and the cradle at hole 21 and the other point is at the cradle end 28 which contacts latch 27 when the breaker is in the untripped position. When the contacts are closed, the main current carrying path proceeds through contact arm 16 and flexible connector 38 as indicated earlier. No proportion of the current flows through the path provided 35 by contact 17, contact arm 16, spring 20, cradle 14 and latch 27 since the latch is not connected to the main current path.

Figure 2:
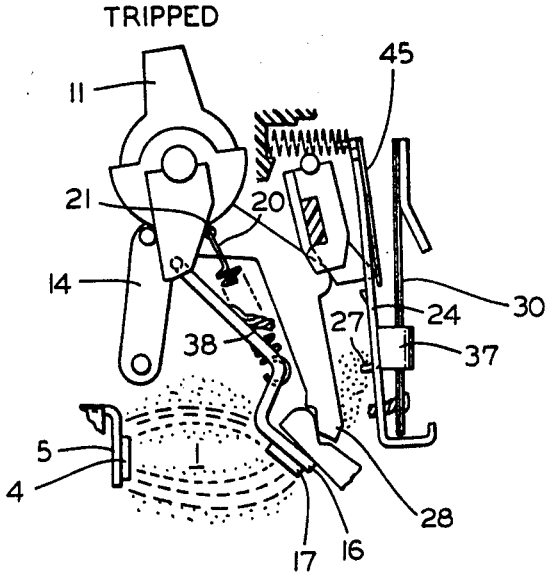
FIG. 2 (PRIOR ART)
FIG. 2 is a side view of a portion of the circuit breaker assembly depicted in FIG. 1 with the breaker contacs in a tripped position.

FIG. 2 shows the breaker in a tripped position immediately after short circuit current has passed through the breaker and an arc 1 is created between stationary contact 4 and movable contact 17. The arc consists of ionized gases in the vicinity of the contacts and is depicted in dashed lines to represent the flow pattern of the arc current. The main path for the arc current is from the stationary contact 4 through the ionized gap between it and the movable contact 17, into the movable contact arm 16 through the flexible conductor 38, the bi-metallic strip 30 and the terminal strap 33. However, this main path is looped and is therefore inductive and can be partially paralleled by the previously described path from the movable contact arm 16 to the latching tip of cradle 14, to the metal latch to the terminal strap 33, through the conductive atmosphere. The sharp protruding edges of both the cradle end as well as the latch readily promote the formation of an arc, as indicated. Careful studies indicate that the formation of an arc between the end of the cradle and the latch occurs during tripping as soon as the arc has become established between the contacts, but when the breaker is interrupting much higher current than the original requirement. This situation differs from that described within the patent to Middendorf wherein arcing is described as occuring upon the immediate separation of the cradle from the latch. The circuit breaker design indicated in FIG. 1 is such that no intentional current transport occurs through the cradle before and after tripping, due to the absence of any connecting means to the terminal strap 33.

To prevent electrical transport from occuring between the cradle and the latch in the presence of an arc during tripping, an insulated latch plate 54 as shown in FIG. 3 is employed. The plate is manufactured from a high pressure laminated insulating thermoset composition. Other electrically insulating materials having good temperature resistant properties such as phenolics, polyesters, linen-phenolic high-pressure laminates may also be employed. The latch consists of a generally rectangular plate 55 having a latch opening 59 for supporting the end of the cradle. Flat tab portions 56 and 57 are provided on the sides of the plate with holes 58 to facilitate mounting to the armature.

The armature 24, shown in FIG. 4 is of a different design than that depicted in FIGS. 1 and 2, however a common reference numeral will be employed for comparison purposes. Armature 24 is fabricated from a single piece of sheet metal and comprises a pair of upright plates 46, 47 joined by top and bottom cross pieces 61, 62. A pair of parallel legs 52, 53 are defined each having holes 51 to facilitate the mounting of latch 54. A pair of flat tabs 48 are provided on the top cross piece for engaging within the body portion of the circuit breaker and a bent tab 49 is formed along the top portion thereof for engaging the armature spring 26 such as shown in FIG. 1. To facilitate mounting the resilient strip 45, also used with the armature depicted in FIG. 1 and FIG. 2, a pair of holes 51 are provided within the top cross piece 61. An armature opening 63 of a generally rectangular configuration is formed between the upright plates for providing access to the resilient strip as described more completely in the aforementioned patent to Klein.

The armature assembly which consists of armature 24, resilient strip 45 and latch 54 is shown in FIG. 5. The resilient strip is attached to the top cross piece 61 by means of a pair of rivets 64 and the latch is connected to the bottom cross piece 62 by means of a pair of rivets 65. Latch 54 is mounted on cross piece 62 in such a manner that a rectangular opening 59A is defined between the bottom 62A of cross piece 62 and the bottom 59B of latch opening 59. This opening assures that the end of the cradle will not come into electrical contact with any portion of the cross piece 62.

The latch assembly is shown in FIG. 6 for operational mounting within the circuit breaker body. The bent tab 49 is at the top for receiving the end of the armature spring and the latch 54 is positioned such that the bottom surface 59B of latch opening 59 can receive the end of the cradle. The resilient strip is depicted both in its rest position and at the extended position which is depicted in dashed lines at 45A.

The circuit breaker containing the armature asserbly depicted earlier in FIGS. 5 and 6 is shown in FIG. 7. Armature 24 is positioned relative to the armature spring 26 and the cradle end 28 rests upon the latch portion 59B. The bi-metallic strip 30 is modified by the addition of a bottom portion 30A to engage with the bottom of the armature 24 in a manner similar to the engagement of the lower end 29 of the armature 24 depicted in FIG. 1. The provision of the insulated latch 54 insures that no current path exists between the cradle 14 and the armature 24 both before, during or after tripping.

To test the efficiacy of the insulative latch concept of this invention, breakers were fabricated in accordance with the design depicted in FIG. 7 and were tested along with breakers having the design depicted in FIG. 1. Both two pole and three pole circuit breakers, attached by the common trip bar arrangement described in the aformentioned patent to Klein were tested to compare the designs. The test consisted of mounting the breakers in a normal atmosphere of air and subjecting each breaker design, in both two and three pole construction, to a short circuit of 240 V, 22,000 amperes which greatly exceeds the original breaker design interrupting capacity requirement. Each breaker design successfully interrupted the 240 V, 22,000 ampere short circuit in both the two and three pole construction. However, when the breakers were reclosed and tested for common tripping, wherein a single breaker is required to trip the other breaker (two pole) or the other two breakers (three pole), only the breakers having the design depicted in.FIGS. 7 and 8 were capable of the common trip function. Evidence of arcing was observed between the engaging surfaces of the cradle and latch within the breakers having the design depicted in FIG. 1, while no such evidence of arcing was observed within the breakers having the design of FIGS. 7 and 8. The force to unlatch breakers having the design depicted in FIG. 1 more than doubled after test, but the force to unlatch breakers having the design depicted in FIG. 7, for example, remained unchanged after test.

The invention contemplates the prevention of the occurrence of an arc between the cradle and the latch during tripping. The insulated latch, as described in reference to FIG. 4 is an inexpensive expedient to this end. Other methods of insulating the latch can also be employed. Tenacious, electrically insulating coatings can be applied to the armature depicted in FIG. 1 such that latch 27 would be electrically insulated by virtue of the coating. The use of such an insulative coating is within the scope of this invention.

FIG. 8 shows the insulated cradle for preventing the occurrence of an arc between the cradle end 28 and the protruding latch 27 depicted in FIG. 1 and 2 wherein the armature 24 and the bi-metallic strip 30 also have the same configuration depicted within these two figures. The cradle 14 is electrically insulated from the cradle end 28 by including an insulated piece 3 and joining the piece by means of rivets 2 to the cradle proximate the cradle shoulder 14A on one side of the insulated piece and to the lower latch portion 14B which includes the latch end 28. The discontinuity in the electrical path back through cradle 14 and spring 20, described earlier, by the imposition of insulated piece 3 deters the formation of an arc between latch 27 and cradle end 28. The insulated cradle depicted in FIG. 8 can be employed in combination with the insulated latch depicted in FIG. 7 and is within the scope of this invention.

Having described our invention, what we claim as new and desire to secure by Letters Patent is:

1. An electric circuit breaker having improved common trip capability comprising:

contact means operatively mounted within an insulated circuit breaker casing for providing electrical connection between a pair of circuit breaker terminals;

handle means for operatively moving said contacts between a closed and open configuration;

tripping means for rapidly moving said contacts from said closed position to said open position upon the occurrence of an overload;

said tripping means comprising metallic cradle having and end in releasable contact with a latch under defined operating conditions and a metallic armature in magnetic relation with one of said breaker terminals for separating said latch and cradle upon occurrence of said overload, said latch preventing said cradle from opening said contacts under a defined range of operating conditions and for allowing said cradle to open said contacts upon the occurence of said overload, said latch comprising an insulating plate secured to a bottom of an opening through said armature for preventing electrical conduction between said cradle and said armature during said overload.

* * * * *